US006435359B1

(12) United States Patent
Priminano

(10) Patent No.: US 6,435,359 B1
(45) Date of Patent: Aug. 20, 2002

(54) BEVERAGE DISPLAY TRAY

(75) Inventor: Bernard Priminano, Marietta, GA (US)

(73) Assignee: Display Industries, LLC., Smyrna, GA (US)

( * ) Notice: Subject to any disclaimer, the term of this patent is extended or adjusted under 35 U.S.C. 154(b) by 0 days.

(21) Appl. No.: 09/721,180

(22) Filed: Nov. 22, 2000

(51) Int. Cl.[7] ..... A47B 73/00

(52) U.S. Cl. ..... 211/75; 211/88.01; 248/811.2

(58) Field of Search ..... 211/75, 74, 71.01, 211/86.01, 87.01, 59.2, 59.3; 248/311.2, 447.1, 447.2, 450, 80, 89, 105, 121, 146, 152, 154, 317, 318, 342

(56) References Cited

U.S. PATENT DOCUMENTS

| | | | | | |
|---|---|---|---|---|---|
| 1,706,081 | A | * | 3/1929 | Schulze | 211/75 X |
| 1,915,958 | A | * | 6/1933 | Skirrow | 211/74 |
| 2,296,700 | A | * | 9/1942 | Branstetter et al. | 211/74 |
| 2,305,965 | A | * | 12/1942 | Henkel et al. | 211/74 |
| 2,490,426 | A | * | 12/1949 | Gerdeman | |
| 2,647,716 | A | * | 8/1953 | Hudziak et al. | |
| 2,865,588 | A | * | 12/1958 | McCartney | |
| 3,762,673 | A | * | 10/1973 | Koslovsky | 248/154 |
| 3,913,878 | A | * | 10/1975 | Wayne | 248/311.2 |
| 4,036,463 | A | * | 7/1977 | Hopkins et al. | 248/110 |
| 4,222,541 | A | * | 9/1980 | Cillis | 248/210 |
| 4,659,099 | A | * | 4/1987 | Malone | 248/311.2 |
| 4,698,936 | A | * | 10/1987 | Helfman | 248/311.2 |
| 4,795,210 | A | * | 1/1989 | Milat | 248/311.2 |
| 4,995,509 | A | * | 2/1991 | Kornfeind | 211/75 |
| 5,022,626 | A | * | 6/1991 | Nozel et al. | 248/311.2 |
| 5,148,755 | A | * | 9/1992 | Morales | 248/311.2 |
| 5,181,621 | A | * | 1/1993 | Plaehn | 211/88.01 |
| 5,362,077 | A | * | 11/1994 | Adamson | 211/74 |
| 5,368,266 | A | * | 11/1994 | Allen | 248/231.4 |
| 5,423,504 | A | * | 6/1995 | Shenkar | 211/88.01 |
| 5,664,367 | A | * | 9/1997 | Huang | 248/311.2 |
| 5,732,862 | A | * | 3/1998 | Bull | 248/311.2 |
| 5,913,433 | A | * | 6/1999 | Belokin et al. | 211/88.01 |
| 6,021,987 | A | * | 2/2000 | Shimota | 248/311.2 |
| 6,073,899 | A | * | 6/2000 | Omrani | 248/311.2 |
| 6,076,793 | A | * | 6/2000 | Yamamoto | 248/311.2 |
| 6,285,544 | B1 | * | 9/2001 | Chandramohan | 248/311.2 |

* cited by examiner

*Primary Examiner*—Daniel P. Stodola
*Assistant Examiner*—Jennifer E. Novosad
(74) *Attorney, Agent, or Firm*—John L. James

(57) ABSTRACT

A display device for a plurality of items, such as two or three liter beverage bottles utilizes a tray attached on top of the shelf support. The tray has a bottom panel with upstanding front and rear sidewall panels attached to the bottom panel. Front flanges are connected to either the bottom panel or front sidewall panel and extend downward to overlap the top of the shelf support. Rear flanges are connected to either the bottom panel or front sidewall panel and also extend downward to overlap the top of the shelf support. The rear flanges each have a threaded opening to receive a thumbscrew with a swivel plate. Tightening the thumbscrews secures the tray to the shelf support.

4 Claims, 1 Drawing Sheet

BEVERAGE DISPLAY TRAY

FIELD OF THE INVENTION

The present invention relates generally to merchandising display shelving for displaying food and/or beverages, and, more particularly, to a display device for use with such shelving.

BACKGROUND OF THE INVENTION

Shelves are used to hold merchandise awaiting purchase in a store. Because shelf space is always limited, there is competition for the shelf space available and there is intense competition for shelf space at eye level. Items at eye level are easy to view and easy to reach making it more likely that the item will be seen and purchased. A common supermarket or convenience store shelving system uses open shelves attached along the rear to a central support, referred to as gondola shelving, where the open ends of the shelves are at the aisle to provide unrestricted access to items thereon without interference with beams, legs or other support devices. With this type shelving system, the top shelf is typically about four to five feet high which is eye level for many, if not most, consumers. Unfortunately, limiting shelf height to four or five feet wastes valuable space in a store that could be used to display more merchandise.

Elaborate, eye-catching displays for beverages are often used in supermarkets and convenience stores to increase beverage sales. Many of these displays tend to place at least some of the beverage containers at eye level where they are easy to see in an effort to promote sales of the beverage. Because of their physical size, most of these elaborate displays can exist only near store entrances or at the ends of some aisles. Accordingly, it will be appreciated that it would be highly desirable to have a display device that can place a beverage container at eye level above the gondola shelving.

SUMMARY OF THE INVENTION

Briefly summarized, according to one aspect of the present invention, a display device for a plurality of beverage bottles comprises a tray having a bottom panel with upstanding front and rear sidewall panels attached to the bottom panel. A front flange is connected to one of the bottom and front sidewall panels and extends downward therefrom. A rear flange is connected to one of the bottom and rear sidewall panels and extends downward therefrom. The rear flange has a threaded opening to receive a threaded member such as a thumbscrew with a swivel plate on one end. The swivel plate pivots to maintain contact with a shelf support even when the shelf support is angled instead of perfectly vertical. The thumbscrew engages the shelf support to hold the display tray in position on top of the shelving. Beverage containers in the tray are above the shelving but are still at eye level and easy to reach.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
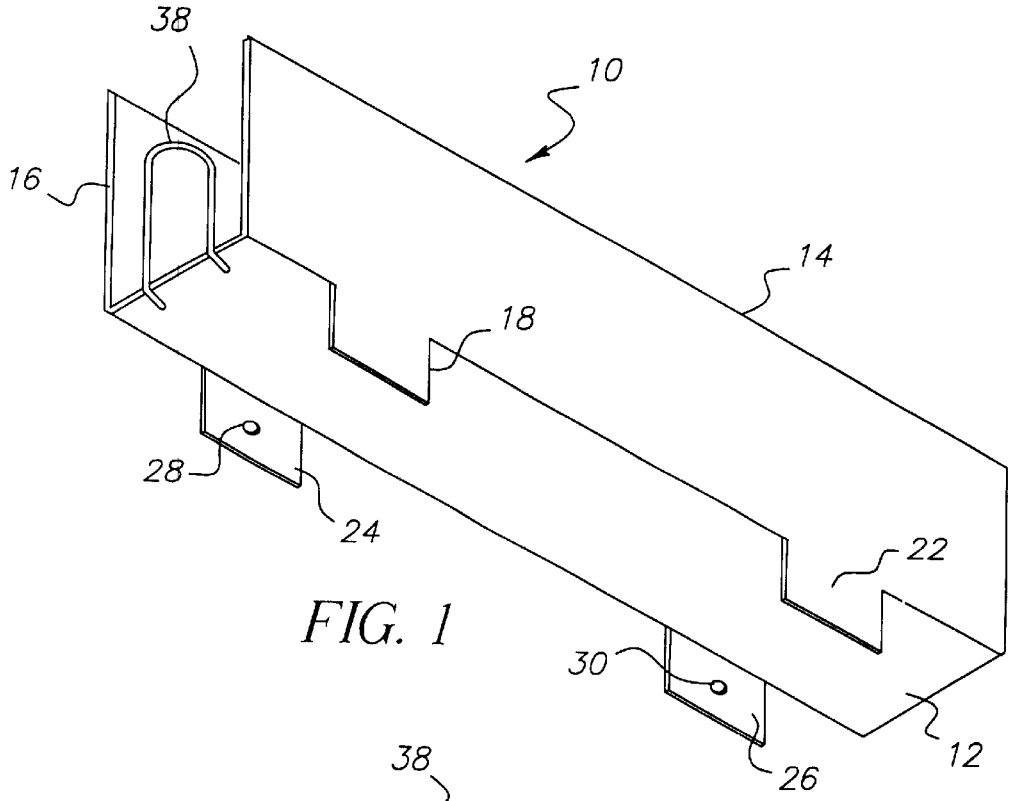
FIG. 1 is a perspective view of a preferred embodiment of a beverage display tray for fitting on top of gondola shelving according to the present invention.
Figure 2:
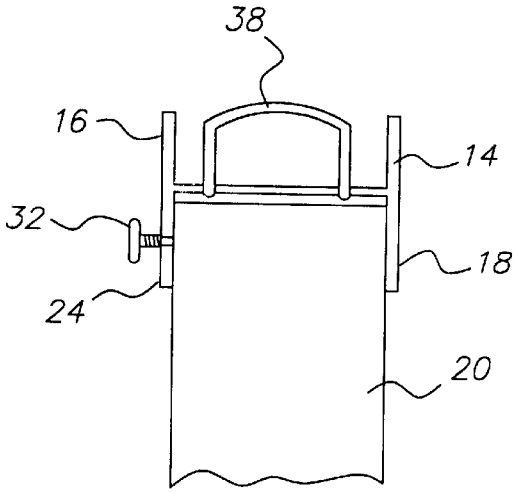
FIG. 2 is a diagrammatic left end view of the tray of FIG. 1 shown attached to the top of a central support of a shelving system using a thumbscrew.

Referring to FIGS. 1–2, there is illustrated a display device adapted to hold and display a plurality of items, particularly two or three liter beverage bottles, at eye level on main aisles of supermarkets and convenience stores. The display device fits on top of common gondola shelving and attaches to the main support for the shelving. The display device has an elongated horizontal tray 10 that has a bottom panel 12 with upstanding front and rear sidewall panels 14, 16 attached to the bottom panel 12. Tray 10 is preferably constructed of metal but may be constructed of plastic or other strong durable material. The width of the tray preferably compliments the bottles it holds, but a three liter tray can be used for smaller size bottles.

Tray 10 has a first front flange 18 that is connected to either the bottom panel 12 (FIG. 4) or the front sidewall panel 14 (FIG. 1) and extends downward therefrom. Normally, flange 18 is attached at the junction of bottom 12 and front sidewall 14 making it an extension of the sidewall, but when the shelf support 20 is narrow, then flange 18 can be moved inboard toward the longitudinal centerline of bottom panel 12 and attached to the bottom panel 12. When the shelf support is wider than the bottom panel, flange 18 can be connected to front sidewall 14 and angled outward away from the longitudinal centerline of the bottom panel making it a nonparallel extension of the sidewall. Where there is substantial disparity between the width of the tray and shelf support 20, then the flange can be formed with an offset to accommodate the extra width. For more substantial disparities, the tray can be constructed to accommodate two rows of bottles instead of one.

A second front flange 22 is spaced from the first front flange 18 and is connected to either the bottom panel or the front sidewall panel like the first front flange 18. Flange 22 also extends downward from the tray, preferably parallel to the front panel 14. The two front flanges are spaced along the tray with one flange near each end of the tray. Sections of shelving are typically three to four feet wide so two front flanges are sufficient. Where wider shelves are encountered, additional flanges can be used.

Flanges are best used in pairs with each front flange having a cooperating rear flange so that first front flange 18 and first rear flange 24 form one pair of flanges, while second front flange 22 and second rear flange 26 also form a pair of flanges. The rear flanges are connected to the bottom panel or sidewall in similar manner to the front flanges. Each rear flange 24, 26 has a threaded opening 28, 30 to receive a threaded member.

Figure 3:
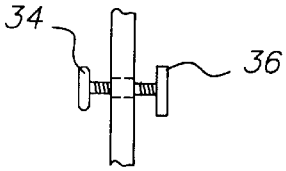
FIG. 3 is a diagrammatic left end view similar to FIG. 2 but illustrating another embodiment of the thumbscrew.

Referring to FIGS. 2–3, threaded member 32 may be simple screw which when turned clockwise to tighten presses against the shelf support 20 thereby fastening the tray to the support. Threaded member 32 may be a slotted screw for use with a screw driver which has the advantage of being somewhat tamper proof to prevent loosening by customers. For ease of installation, however, a thumbscrew 34 is preferred to eliminate the need for tools, and a swivel plate 36 compensates for angled or tapered support members.

Again referring to FIGS. 1–2, a stop member 38 is positioned between the front and rear sidewalls 14, 16 and connected to an end portion of the bottom panel 12. The stop member 38 prevents beverage bottles from sliding off the ends of the tray. Stop member 38 is preferably a rod having an inverted U-shape. The end portions of the rod are bent, flattened and fastened to the bottom panel, preferably by braising, welding or the like. Of course, the ends of the tray could be solid or perforated panels, but the rods give better visibility of the bottle labels.

Figure 4:
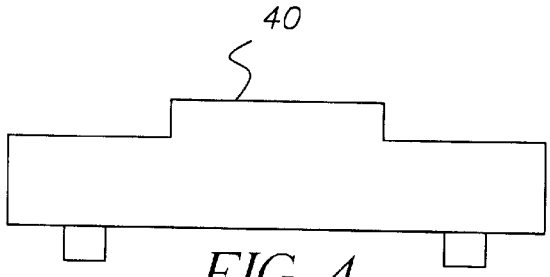
FIG. 4 is a diagrammatic front view of a tray similar to FIG. 1 but illustrating another embodiment with an elevated tray panel.

Referring to FIG. 4, a third front flange 40 is connected to the front sidewall panel and extends upward to provide aesthetic appeal. The third front flange is positioned between the first and second front flanges but extends in the opposite direction. While shown with a rectangular configuration, flange 40 can have a more decorative configuration.

It can now be appreciated that a display device has been presented for displaying a plurality of items, especially two and three liter beverage bottles. It utilizes a tray attached on top of the shelf support. The tray has a bottom panel with upstanding front and rear sidewall panels attached to the bottom panel. Front flanges are connected to either the bottom panel or front sidewall panel and extend downward to overlap the top of the shelf support. Rear flanges are connected to either the bottom panel or front sidewall panel and also extend downward to overlap the top of the shelf support. The rear flanges each have a threaded opening to receive a thumbscrew with a swivel plate. Tightening the thumbscrews secures the tray to the shelf support.

While the invention has been described with particular reference to the preferred embodiments, it will be understood by those skilled in the art that various changes may be made and equivalents may be substituted for elements of the preferred embodiments without departing from invention. For example, where the flanges fit snugly over the shelf support, the flanges may be lengthened to eliminate the need for screws. Also, the flanges can be formed by bending a small panel out of the sidewall panels leaving openings in the sidewalls. It is accordingly intended that the claims shall cover all such modifications and applications as do not depart from the true spirit and scope of the invention.

What is claimed is:

1. A display device for holding a plurality of items on top of a shelf, said display device, comprising:

a tray having a bottom panel with a longitudinal axis, a middle panel portion, and upstanding front and rear sidewall panels attached to said bottom panel on opposite sides of said longitudinal axis;

a stop member upstanding from an end portion of said bottom panel, said stop member being a rod having an inverted U-shape with end portions bent, flattened and fastened to said bottom panel;

a front flange connected to one of said bottom panel and said front sidewall panel and extending downward below said bottom panel parallel to said front sidewall panel, said front flange being positioned nearer said middle panel portion than said stop member;

a rear flange connected to one of said bottom panel and said rear sidewall panel and extending downward therefrom below said bottom panel, said rear flange having a threaded opening, said rear flange being positioned nearer said middle panel portion than said stop member;

a threaded member extending through said threaded opening, said threaded member being movable inward toward said longitudinal axis; and a swivel plate on one end of said threaded member positioned between said front and rear flanges, said swivel plate being adapted to press against the shelf to fasten said display device to the shelf when said threaded member moves inward toward said longitudinal axis.

2. A display device, as set forth in claim 1, wherein said threaded member is a thumbscrew.

3. A display device, as set forth in claim 1, including an upper flange extending upward from said front sidewall panel, said upper flange being positioned nearer said middle panel portion than said stop member.

4. A display device for holding a plurality of beverage bottles on top of a shelf, comprising:

an elongated horizontal tray having a bottom panel with upstanding front and rear sidewall panels attached to said bottom panel;

a first front flange connected to one of said bottom panel and said front sidewall panel and extending downward therefrom below said bottom panel;

a second front flange, spaced from said first front flange, connected to one of said bottom panel and said front sidewall panel and extending downward therefrom below said bottom panel;

a first rear flange connected to one of said bottom panel and said rear sidewall panel and extending downward therefrom below said bottom panel, said first rear flange having a threaded opening;

a first thumbscrew in said threaded opening of said first rear flange;

a first swivel plate attached to said first thumbscrew;

a second rear flange connected to one of said bottom panel and said rear sidewall panel and extending downward therefrom, said second rear flange having a threaded opening;

a second thumbscrew in said threaded opening of said second rear flange;

a second swivel plate attached to said second thumbscrew;

a stop member positioned between said front and rear sidewalls and connected to an end portion of said bottom panel, said stop member being a rod having an inverted U-shape with end portions bent, flattened and fastened to said bottom panel; and a third front flange positioned between said first and second front flanges, said third flange being connected to said front sidewall panel and extending upward therefrom above said front sidewall panel.

* * * * *